United States Patent [19]

Fry

[11] Patent Number: 4,536,983

[45] Date of Patent: Aug. 27, 1985

[54] RELOADER FOR MUZZLE LOADERS

[76] Inventor: Daniel J. Fry, 731 Prospect Ave., Van Wert, Ohio 45891

[21] Appl. No.: 522,442

[22] Filed: Aug. 12, 1983

[51] Int. Cl.[3] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 243,250 | 6/1881 | Hall | 42/90 |
| 4,050,175 | 9/1977 | Mulinix . | |
| 4,152,858 | 5/1979 | Dobbs . | |
| 4,207,698 | 6/1980 | Burson . | |
| 4,229,897 | 10/1980 | Snowden . | |
| 4,373,285 | 2/1983 | Grout et al. | 42/90 |

*Primary Examiner*—Charles T. Jordan

[57] ABSTRACT

This invention relates to reloading devices for muzzle loading rifles or muskets in general, and more specifically to a construction, wherein a frangible sheet of material is used to maintain the powder and ball in their proper orientation, due to the frictional engagement between two cooperating elements, one of which houses a plunger that can be actuated to tear the sheet of material, and introduce the charge and projectile into the barrel of a firearm.

7 Claims, 5 Drawing Figures

RELOADER FOR MUZZLE LOADERS

BACKGROUND OF THE INVENTION

The prior art is replete with devices designed to effect the quick re-loading of muzzle loading rifles, as can be seen by reference to U.S. Pat. Nos. 4,207,698; 4,229,897; 4,152,858 and 4,050,175.

While all of the above mentioned prior art devices are adequate for their intended purpose, they do function in different manners, and have been found to be unduly complex, either in their operation, or in the number of parts that they employ.

As an example, U.S. Pat. No. 4,152,858 is both structurally and functionally similar to the present invention, and operates on the same basic principles; however, this particular reference requires that an intermediate sleeve 48 be slidingly received within the two major components designated by the reference numerals 12 and 30, in order to retain the frangible disk 50 in place. While this construction results in the positive capture of the disk or membrane 50, it also requires an additional component, that not only adds to the cost of the device, but also renders the patented device inoperable, should the sleeve become misplaced or lost.

The muzzle loader that forms the basis of the present invention was developed upon the principle that a device constructed from the least number of parts or components necessary will produce the simplest, most reliable, and efficient device possible.

SUMMARY OF THE INVENTION

An object of the present invention is to produce an improved loader for muzzle loading rifles.

Another object of the present invention is to provide a loader for muzzle loading rifles, that employs the least number of components possible.

Still another object of the present invention is to provide a loader for muzzle loaders, that employs a unique locking mechanism for a frangible disk or membrane.

Yet another object of the present invention is to provide a loading device, that is simple, efficient and reliable in the field.

A further object of the present invention is the provision of a loading device for muzzle loaders, that by virtue of its construction, and the relationship between the limited number of working parts, is virtually impossible to break, or even misplace one of the components.

These and other objects, advantages, and novel features of the invention will become apparent from the detailed description that follows, when considered in conjunction with the accompanying drawings.

DETAILED DESCRIPTION OF THE PREFERRED EMBODIMENT

As can be seen by reference to the drawings, the loader device that forms the basis of the present invention is designated generally as 10, and comprises a plunger member 20, a plunger chamber 30, and a locking collar 40.

Figure 1:
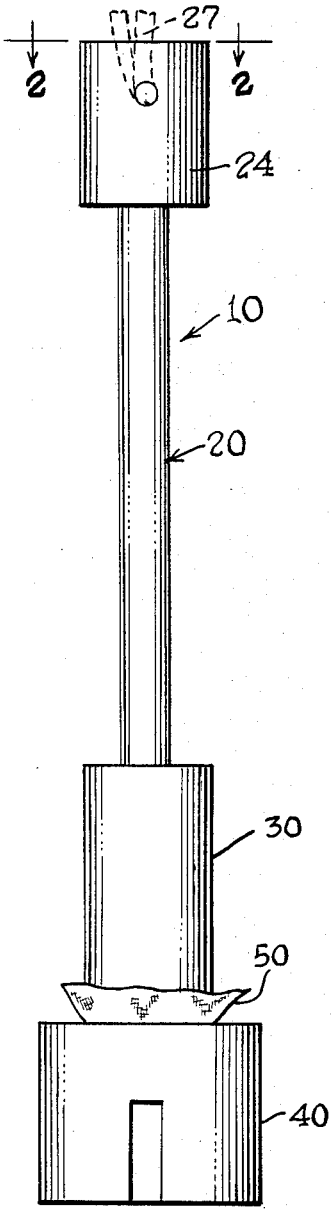
FIG. 1 is a side elevation of the loading device.
Figure 2:
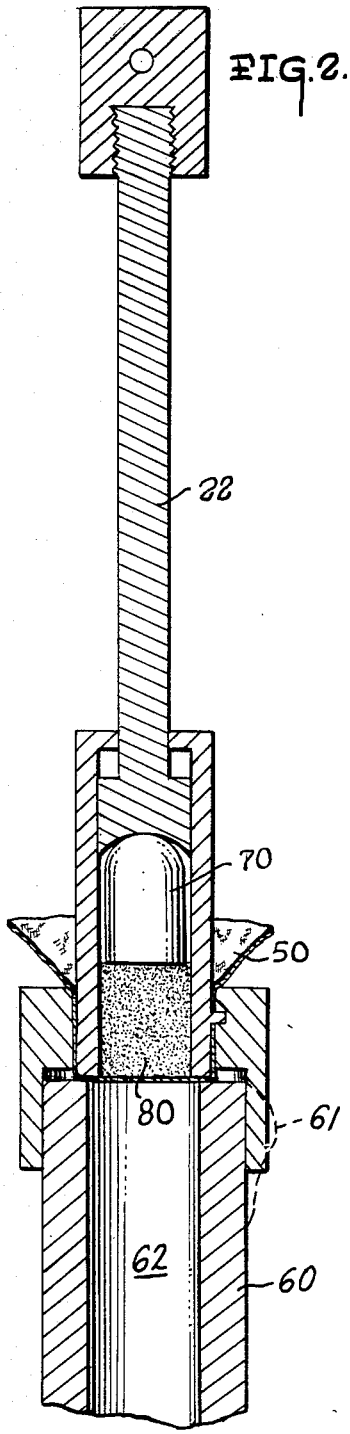
FIG. 2 is a cross-sectional view of the loading device, immediately prior to the loading function commencing.
Figure 3:
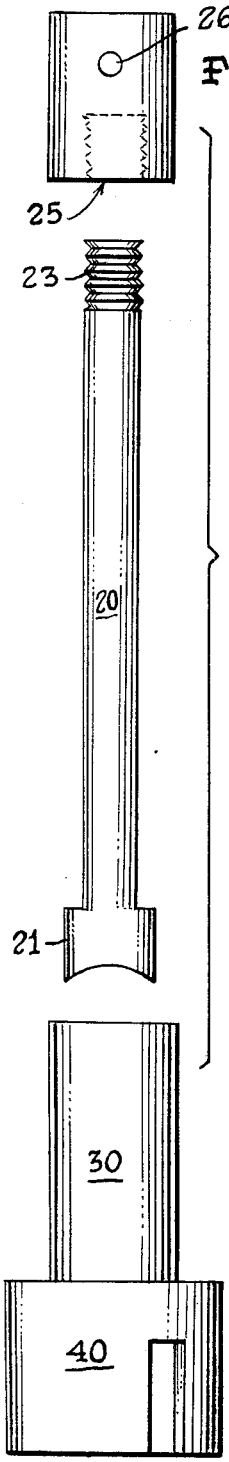
FIG. 3 is an exploded perspective view of the various components that comprise the loading device.

As can best be seen in FIGS. 2 and 3, the plunger member 20 comprises an enlarged plunger head 21, disposed on one end of an elongated shaft 22, that is provided with a threaded portion 23 on its other end. In addition, the plunger member 20 is further provided with an enlarged generally cylindrical cap member 24, having a threaded recess 25 dimensioned to receive the threaded end 23 of the shaft 22, and a transverse aperture 26 that is dimensioned to receive a lanyard 27 or the like, shown in phantom in FIG. 1.

Figure 4:
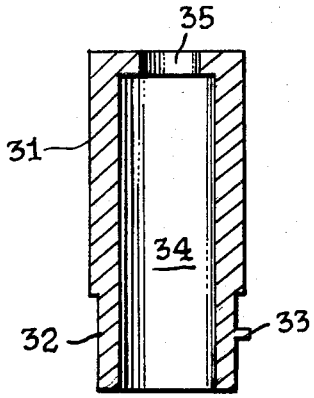
FIG. 4 is a detailed cross-sectional view of the plunger chamber.

The plunger chamber 30, as can best be seen in FIGS. 2 and 4, comprises a generally elongated hollow cylinder 31 having a shallow, reduced diameter, stepped shoulder portion 32 on its lower end, and a tang or projection 33 that projects outwardly from the shallow reduced diameter portion 32. The interior of the plunger chamber 30 comprises; an elongated enlarged bore 34, that is dimensioned to slidingly receive the plunger head 21; and a reduced diameter bore 35, that is dimensioned to slidingly receive the elongated plunger shaft 22.

Figure 5:
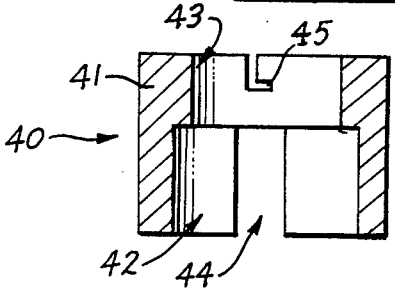
FIG. 5 is a cross-sectional view of the membrane locking collar.

The membrane locking collar 40, illustrated in FIG. 5, comprises an enlarged, relatively short, hollow cylindrical member 41, whose exterior diameter is substantially larger than the exterior diameter of the plunger chamber 30 with which it cooperates, to frictionally engage and lock in place a membrane 50 as shown in FIG. 2.

The membrane locking collar 40 further comprises; an enlarged internal bore 42 on its lower portion, that is dimensioned to receive a portion of the muzzle 60 of a muzzle loading firearm; and a reduced diameter bore 43 on its upper portion, whose depth is approximately equal to the length of the shallow reduced diameter portion 32 of the plunger chamber, and whose internal diameter is approximately equal to the major external diameter of the plunger chamber 30.

In addition to the above, the membrane locking collar 40 is also provided with; an elongated slot 44 that communicates with the enlarged bore 42, and which is dimensioned to accommodate the front sight member 61 (shown in phantom in FIG. 2) normally found on some types of muzzle loading firearms; and an L-shaped locking recess 45 formed in the reduced diameter bore 43, which is dimensioned to receive the projection 33 on the exterior of the plunger chamber, to lock the plunger chamber 30 and the collar 40 together.

Prior to discussing the operation of the loading device, it should be emphasized that the relative dimensioning of the reduced diameter bore in the locking collar, and the shallow reduced diameter portion of the plunger chamber, are chosen such that they will cooperate to frictionally engage and lock in place a frangible membrane 50 interposed between them, as shown in FIG. 2.

Furthermore, it is recognized and accepted in accordance with the teachings of this invention, that the frangible membrane 50 will experience tearing in the vicinity of the locking recess 45 and projection 33. However, the portions of the membrane 50 below the projection, and surrounding the lower portion of the plunger chamber, will remain intact until subjected to the influence of the plunger 20.

The device 10 is loaded prior to use as follows; the plunger 20 is fully retracted within the plunger chamber 30; a ball or bullet 70 is introduced into the chamber followed by a charge 80 of gunpowder; a frangible membrane of paper or the like is placed over the open end of the chamber, and extending beyond the reduced diameter portion on the exterior of the chamber; the locking collar is brought into engagement with that portion of the membrane disposed around the sides of the chamber; the collar is then forced upwardly (as shown in the drawings) until the recess 45 comes close to engaging the projection 33, whereupon localized tearing of the membrane occurs; the collar is then manipulated to complete the locking process; and the device is now ready for use.

The actual loading is accomplished by placing the collar 40 over the muzzle 60, whereupon the plunger chamber 30 is aligned with the muzzle bore 62, and then exerting a downward force on the plunger to force the frangible membrane to fracture, and deposit the ball and charge down the bore.

Having thereby described the subject matter of this invention, it should be obvious that many substitutions, modifications, and variations are possible in light of the above teachings. It is therefore to be understood that the invention as taught and described herein, is only to be limited to the extent of the breadth and scope of the appended claims.

I claim:

1. A reloading device used to deposit a ball, a charge of powder, and at least a portion of a frangible membrane, into the bore of a muzzle loading firearm, wherein the reloading device comprises:

a plunger chamber, comprising an elongated hollow cylinder dimensioned to receive the ball and the charge of powder, and having a shallow reduced dimater portion on its exterior surface, and a projection extending outwardly from the shallow reduced diameter portion, a plunger member slideably disposed in the plunger chamber, and a locking collar having an internal recess dimensioned to receive the said projection on the plunger chamber, to join the locking collar and the plunger chamber together.

2. A reloading device as in claim 1; wherein the locking collar is provided with an enlarged bore in its lower portion, and a reduced diameter bore in its upper portion.

3. A reloading device as in claim 2; wherein, the said internal recess in the locking collar is formed in the reduced diameter bore in its upper portion, and the recess is L-shaped in configuration.

4. A reloading device as in claim 3; wherein, the locking collar is further provided with an elongated slot that extends into the enlarged bore in its lower portion.

5. A reloading device as in claim 4; wherein, the depth of the reduced diameter bore is approximately equal to the length of the shallow reduced diameter portion on the plunger chamber.

6. A reloading device as in claim 5, wherein, the diameter of the reduced diameter bore is approximately equal to the major diameter of the plunger chamber.

7. A reloading device as in claim 6; wherein, the locking collar and the plunger chamber are dimensioned so as to frictionally engage a frangible membrane disposed intermediate them, to retain the ball and charge of powder within the plunger chamber.

* * * * *